US006378597B1

(12) United States Patent
Zecman

(10) Patent No.: US 6,378,597 B1
(45) Date of Patent: Apr. 30, 2002

(54) SHOT SLEEVE ASSEMBLY

(75) Inventor: Kenneth Zecman, Farmington Hills, MI (US)

(73) Assignee: Investors Holding Group

( * ) Notice: Subject to any disclaimer, the term of this patent is extended or adjusted under 35 U.S.C. 154(b) by 0 days.

(21) Appl. No.: 09/663,746

(22) Filed: Sep. 15, 2000

(51) Int. Cl.[7] ..... B22D 17/10; B22D 17/20
(52) U.S. Cl. ..... 164/312; 164/113
(58) Field of Search ..... 164/312, 113

(56) References Cited

U.S. PATENT DOCUMENTS 4,623,015 A 11/1986 Zecman
4,635,851 A 1/1987 Zecman
4,667,729 A 5/1987 Zecman
4,678,429 A 7/1987 Zecman
4,886,107 A 12/1989 Zecman
4,926,926 A 5/1990 Zecman
5,012,856 A 5/1991 Zecman

*Primary Examiner*—Kuang Y. Lin
(74) *Attorney, Agent, or Firm*—Young & Basile, P.C.

(57) ABSTRACT

A shot sleeve assembly for moving molten metal into a mold cavity. The assembly includes an elongated horizontal shot sleeve; an injection piston slidably mounted in the bore of the shot sleeve; and an annular cooling cell positioned over the end of the sleeve adapted to be positioned proximate the mold cavity. The cooling cell defines a continuous coolant passage extending from a coolant inlet to a coolant outlet. The passage has a selectively varying axial width so that the passage may present more surface area in surrounding relation to an upper circumferential region of the sleeve bore than to a lower circumferential region of the sleeve bore whereby to maximize cooling of the upper region of the bore and minimize cooling of the lower region of the bore. The cooling cell is formed of an inner cell sleeve fitted over the shot sleeve and an outer cell sleeve fitted over the inner cell sleeve and coacting at its inner periphery with a groove formed in the outer periphery of the inner cell sleeve to define the coolant passage.

21 Claims, 2 Drawing Sheets

SHOT SLEEVE ASSEMBLY

FIELD OF THE INVENTION

This invention relates to an apparatus for casting molten metals such as aluminum or magnesium. More specifically, it relates to an improved shot sleeve assembly for use in casting these molten metals. Yet more specifically, it relates to an improvement of the shot sleeve assembly disclosed in my U.S. Pat. No. 4,926,926.

BACKGROUND OF THE INVENTION

A shot sleeve is a device for injecting molten metals such as magnesium and aluminum into a die or mold. Relatively simple in construction, it typically comprises a steel sleeve defining an axial bore and a piston slidably fitted in the bore to act as an injection ram. An aperture in the wall of the sleeve opens into a portion of the cylinder bore just in front of the piston when it is in the rest position. This aperture is called a "well" and the molten metal is poured into the well for temporary residence in the bore before the piston is actuated.

Because of the high temperature difference between the molten casting metal and the steel sleeve, it is important to minimize the temperature build up in the sleeve during the casting process. It should be understood that the steel sleeve is not heating uniformly because the molten metal lays primarily in the bottom half of the sleeve.

This unequal heating of the sleeve bore and subsequent distortion causes piston wear. The flow path of the metal exiting the sleeve mouth also heats the sleeve bore causing distortion which, again, affects piston life and the effectiveness of the compression on the molten or semisolid metal in the biscuit of metal remaining in the sleeve bore at the end of the piston injection stroke.

Many arrangements have been provided in the past to provide controlled cooling. For example, controlled cooling is achieved in the shot sleeve assembly of my U.S. Pat. No. 4,926,926 by the provision of a copper cladding layer over the die end of the shot sleeve. According to a further cooling technique, a spiral groove is provided around the die end of the sleeve and coolant such as water is circulated through the groove in a controlled manner. Although this arrangement is generally effective to provide the desired cooling, it inherently provides the same magnitude of cooling with respect to both the top and bottom regions of the sleeve bore. However, between pouring of the molten metal and actuation of the piston, the molten metal may sit in the bottom of the horizontal sleeve for several seconds, for example 2–10 seconds depending on the shot weight and other parameters. The molten metal residing in the bottom of the sleeve of course undergoes cooling during this time. If the sleeve is thereafter cooled too aggressively, the portion of the molten metal residing in the lower region of the sleeve may be cooled to a point of freezing prior to injection into the die. This is of course counterproductive to the casting process and the quality of the castings being made. Accordingly, the spiral groove is positioned some distance from the working inside diameter of the sleeve bore to prevent metal chill.

SUMMARY OF THE INVENTION

This invention is directed to the provision of a shot sleeve assembly having improved provision for cooling.

More specifically, this invention is directed to the provision of a cooling arrangement for a shot sleeve assembly wherein the cooling around the circumference of the bore is selectively controlled to avoid solidification while retaining the overall benefits of cooling.

The shot sleeve assembly of the invention is designed for moving molten metal into a mold cavity and includes an elongated horizontal shot sleeve having a bore extending axially therethrough from a first end to a second end, adapted to be positioned proximate the mold cavity, and a well opening extending through an upper region of the sleeve at a location adjacent the first end; an injection piston slidably mounted in the bore; and a cooling cell positioned over the second end of the sleeve to cool the molten metal moving through the bore.

According to the invention, the cooling cell defines a continuous coolant passage extending from a coolant inlet to a coolant outlet and the passage presents more surface area in surrounding relation to an upper circumferential region of the bore than to a lower circumferential region of the bore. This arrangement provides selective cooling of the bore whereby to provide less cooling to the lower circumferential region of the bore so as to avoid solidification of metal residing in the lower region of the bore.

According to a further of the invention, the inlet and outlet are in a lower region of the cell and the passage includes an inlet passage region proximate the inlet, an outlet passage region proximate the outlet, and a central passage region interconnecting the inlet and outlet passage regions and extending upwardly and around the upper circumferential region of the bore; and the central passage region has a larger axial width than the inlet and outlet passage regions whereby to present more cooling surface area proximate the upper circumferential region of the bore than proximate the lower circumferential region of the bore. This specific configuration provides a ready and efficient means of selectively varying the extent of cooling provided to the upper and lower regions of the bore. In the disclosed embodiment of the invention, the bore and cooling cell have a circular cross-sectional configuration and the passage is arcuate and is centered on the axis of the bore.

According to a further feature of the invention, the shot sleeve assembly further includes a copper cladding layer, of the type, for example, shown in my U.S. Pat. No. 4,926,926, interposed between the shot sleeve and the cooling cell. The copper cladding layer augments the cooling capacity of the shot sleeve and, specifically, acts to quickly even the distribution of heat around the sleeve diameter and transfer heat to the cooling cell. By creating an even distribution of heat, the bore will stay round and true.

According to a further feature of the invention, the copper cladding layer further acts to facilitate the compression fitting of the cooling cell on the sleeve and specifically, by virtue of its higher coefficient of thermal expansion as compared to the ferrous metal of the shot sleeve, expands when heated to ensure a compression fit of the cooling cell on the sleeve.

According to a further feature of the invention, the cooling cell is formed of an inner cell sleeve fitted over the shot sleeve and an outer cell sleeve fitted over the inner cell sleeve and coacting at its inner periphery with the outer periphery of the inner cell sleeve to define the coolant passage. This arrangement facilitates the provision of a coolant passage having the desired circumferentially selective configuration.

In the disclosed embodiment of the invention, the inlet and outlet extend through a bottom region of a side wall of the outer cell sleeve for communication with the coolant passage. This specific inlet and outlet location allows the coolant passage to extend in a continuous circular fashion around substantially the entire circumference of the shot sleeve. However, the inlet and outlet may alternatively be located on either side of the sleeve diameter; at the pour hole end of the sleeve; or at the top of the sleeve.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

The shot sleeve assembly 10 of the invention will be understood to be utilized to provide molten metal in sequential or shot form to a die apparatus (not shown) defining a mold cavity to receive the molten metal.

Figure 1:
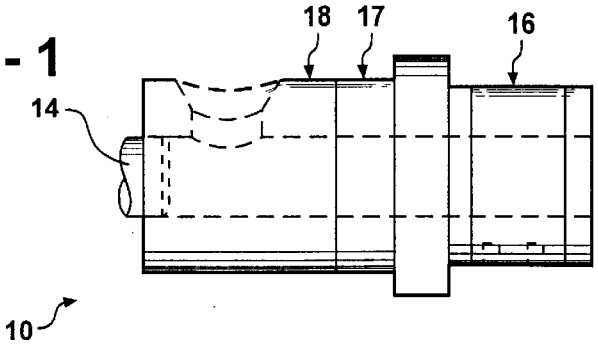
FIG. 1 is a schematic view of a shot sleeve assembly according to the invention.

Shot sleeve assembly 10, broadly considered, includes (FIGS. 1 and 2) a sleeve barrel 12, a piston or plunger 14, a cooling cell section 16, a collar section 17, and a pour hole section 18. Unless otherwise indicated, the components of the shot sleeve assembly are formed of a suitable ferrous material.

Sleeve barrel 12 has a cylindrical configuration and includes a bore 12*a* extending horizontally through the sleeve from a pour hole end 12*b* to a die end 12*c*. A flange 12*d* is provided proximate die end 12*c*. The sleeve 12 preferably has a circular cross-sectional configuration centered on a central axis 13. A well or pour hole 12*e* is provided in the upper circumferential region of the sleeve proximate the pour hole end 12*b* for communication with central bore 12*a*. It will be understood that the well 12*e* allows molten metal to be poured from a ladle or other pouring implement (not shown) into the central bore 12*a* of the sleeve. The exterior surface of sleeve 12 is selectively cut away to define axially spaced annular land or rib portions 12*f* separated by annular recessed regions 12*g*. A copper cladding or jacketing 19 is positioned in recessed regions 12*g*.

Piston 14 has a cylindrical configuration and is fitted slidably in the bore 12*a*. It will be understood that piston 14 is moved to the right as viewed in FIG. 2 following the pouring of molten metal into the bore 12*a* through the well 12*d* to move the molten metal into the mold cavity defined by the die positioned proximate the die end of the shot sleeve, whereafter the piston is withdrawn to the position seen in FIG. 2 to await the introduction of a new quantity of molten metal into the bore through the well.

Cooling cell section 16 (see also FIGS. 3–7) is formed of an inner cell sleeve 20 and an outer cell sleeve 22. Both sleeves have an annular generally cylindrical configuration.

Inner sleeve 20 includes a flange portion 20*a* and a sleeve portion 20*b*. The outer periphery or circumference of sleeve portion 20*b* is selectively cut away or relieved to define a continuous generally circular outwardly opening groove 20*c* extending around the outer circumference of the sleeve portion and having an axial width that varies selectively around the circumferential extent of the groove.

Figure 5:
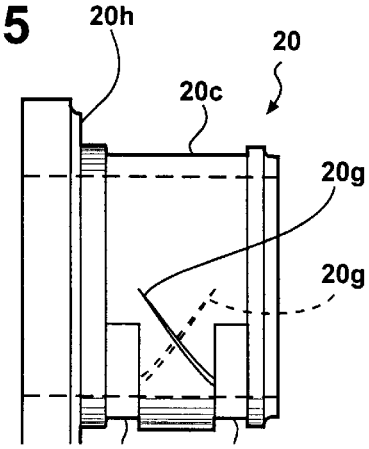
FIGS. 5 and 6 are side elevational views of components of the cooling cell.
Figure 4:
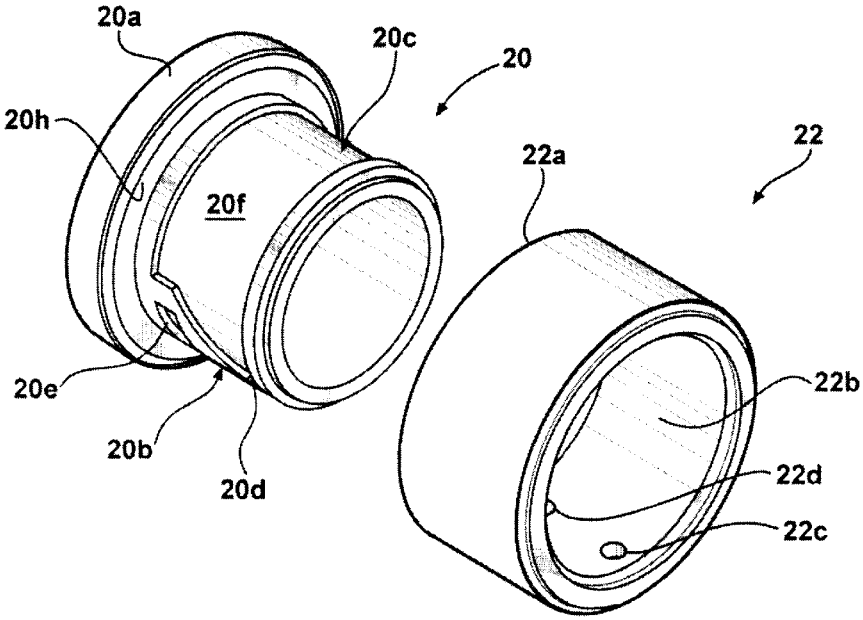
FIG. 4 is an exploded perspective view of a cooling cell utilized in the shot sleeve assembly.
Figure 7:
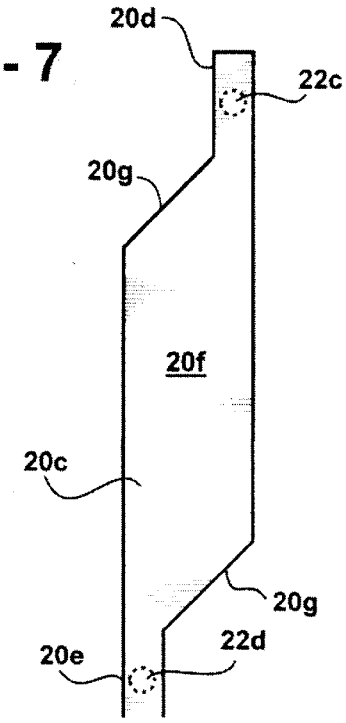
FIG. 7 is a developed view showing a circumferential groove provided in one of the components of the cooling cell.

Groove 20*c* is seen as formed in circumferential fashion on the sleeve portion 20*b* of inner cell sleeve 20 in FIGS. 4 and 5 and is seen in developed form in FIG. 7. Groove 20*c* will be seen to have an inlet/outlet passage portion 20*d* of relatively narrow axial width, an inlet/outlet passage portion 20*e* of relatively narrow axial width and spaced axially from portion 20*d*, and a central passage portion 20*f* interconnecting portions 20*d* and 20*e* and having a relatively large axial width as compared to the axial width of the portions 20*d* and 20*e*. For example, central passage portion 20*f* may have an axial width substantially equal to the axial width of sleeve portion 20*b*.

Angled lead and exit edges 20*g* are provided at the transition between groove portions 20*d* and 20*f* and groove portions 20*f* and 20*e* to facilitate smooth laminar flow of a suitable cooling fluid between the portions.

Figure 6:
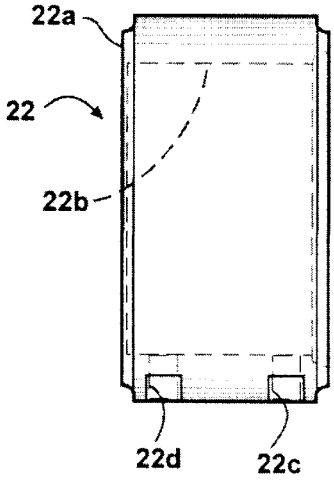

Outer cell sleeve 22 is designed to fit telescopically over and be suitably fixedly secured to the sleeve portion 20*b* of inner cell sleeve 20 with the annular left-hand edge 22*a* of the outer sleeve (as seen in FIG. 6) moving into abutting relation with the annular right-hand edge 20*h* of the flange portion 20*a* of sleeve 20 (as viewed in FIG. 5) and with the inner periphery 22*b* of the outer sleeve overlying and coacting with the groove portions 20*d*, 20*e*, and 20*f* in the sleeve portion of the outer sleeve to define a continuous circumferential passage 24 having the same axial and circumferential configuration as the combined groove portions 20*d*, 20*e* and 20*f*.

Specifically, passage 24 includes an inlet/outlet passage portion 24*a* coinciding with groove portion 20*d*, an inlet/outlet passage portion 24*b* coinciding with groove portion 24*e*, and a central passage portion 24*c* coinciding with central groove portion 20*f*.

An inlet/outlet port 22*c* extends through outer sleeve 22 for communication with groove portion 20*d* and passage portion 24*a* and a further inlet/outlet port 22*d* extends through outer sleeve 22 for communication with groove portion 20*e* and passage portion 24*b*. Inlet/outlet ports 22*c*/22*d* are preferably provided in the extreme bottom circumferential region of outer sleeve 22 in axially spaced relation and in axial alignment. It will be seen that ports 22*c*/22*d* coact with passage portions 24*a*, 24*b* and 24*c* to define a continuous passage extending in circular fashion around the cooling cell.

Note that groove portions 20*d* and 20*e* and the corresponding passage portions extend circumferentially beyond the respective inlet/outlets 22*c*/22*d* so that there is a certain amount of circumferential overlap as between groove portions 20*d* and 20*e* and so that the effective cooling area in the overlapped groove portions is the cumulative axial area of the two side-by-side groove portions. The extent, if any, of circumferential overlap of the end portions of the groove/passage portions may of course be selectively varied to selectively vary the amount of cooling action imparted to the lower region of the shot sleeve bore.

Collar section 17 has an annular configuration, is sized to fit over sleeve barrel 12, and includes a collar portion 17*a*.

Pour hole section 18 has an annular configuration, is sized to fit over sleeve barrel 12, and includes a pour hole 18*a* for coaction with the pour hole 12*e* in the sleeve barrel.

Cooling cell section 16 is fitted slidably over the pour hole end 12*b* of the sleeve barrel and moves slidably along the barrel until collar 20*a* moves into abutting engagement with sleeve barrel flange 12*d,* whereafter collar section 17 is slid over the sleeve barrel and into abutting engagement with the cooling cell section, whereafter pour hole section 18 is slid over the sleeve barrel into abutting engagement with the collar section with pour hole 12*a* moving into alignment with pour hole 12*e,* whereafter a welding operation is performed at annular interface 24 to lock the sections in place on the sleeve barrel. In each case, the respective section (cooling cell section, collar section, and pour hole section) has an inner diameter slightly less than the outer diameter of the sleeve barrel and is heated prior to positioning over the sleeve barrel to allow the section to pass over the barrel whereafter, upon cooling, the section is shrunk fit to the barrel. The steel land portions 12*f* are provided at the ends of the sections and at the junctions of the sections so that the sections may shrink onto a firm steel foundation.

It will be understood that the completed shot sleeve assembly is assembled into a suitable die apparatus with collar portion 17*a* trapped between the platen machine and the cover half of the die apparatus.

Figure 2:
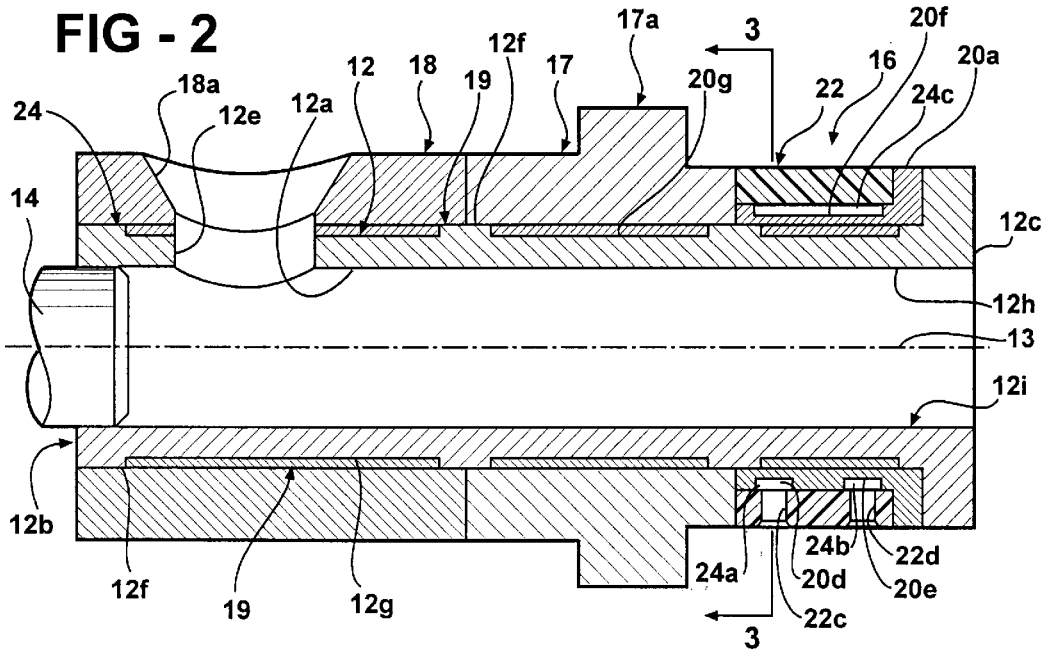
FIG. 2 is a cross-sectional view of the shot sleeve assembly.
Figure 3:
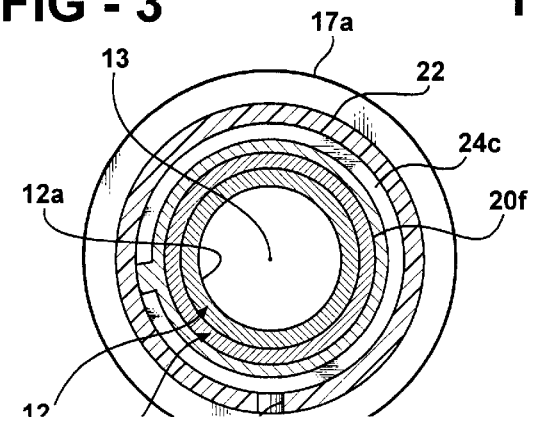
FIG. 3 is a cross-sectional view taken on line 3—3 of FIG. 2.

In operation, with piston 14 in the withdrawn position seen in FIG. 2, hot molten metal such as aluminum or magnesium is poured through aligned wells 18*a*/12*e* and into bore 12*a* whereafter the piston 14 is moved to the right as seen in FIG. 2 to move the molten metal through the bore 12*a* and discharge the molten metal into the mold cavity defined by the associated die. Simultaneously, a cooling liquid such as water is circulated through the coolant passage 24. The coolant may either enter through port 22*d* and exit through port 22*c* or may enter through port 22*c* and exit through port 22*d* depending on the geometries of the particular application.

In any event, and irrespective of the direction of circulation of the cooling water, it will be seen that by virtue of the narrow axial width of the passage portions 24*a* and 24*b* as compared to the wide axial width of the central passage portion 24*c,* the passage presents substantially more surface area in surrounding relation to the upper circumferential region 12*h* of the bore 12*a* than to the lower circumferential region 12*i* of the bore 12*a* with the result that a greater cooling action is imparted to the metal flowing in contact with the upper region 12*h* of the bore than the metal flowing in contact with the lower region 12*i* of the bore.

This circumferential cooling differentiation is advantageous in many applications since, prior to actually casting the molten metal, the liquid metal may sit in the bottom region of the bore for several seconds, for example 2–10 seconds depending on the shot weight and other parameters, with the result that the liquid metal moving through the lower region of the bore is significantly cooler than the liquid metal moving through the upper region of the bore with the result that, if cooling action is supplied uniformly to the upper and lower regions of the bore, the molten metal moving through the lower region of the bore could be cooled to a point of freezing a portion of the metal prior to injection into the die which of course is counterproductive to the casting process and the quality of the castings being made.

The described arrangement provides excellent cooling to the relatively hot metal moving through the upper region of the bore, by virtue of the wide large area passage provided in association with the upper region of the bore, while at the same time allowing the cooling action imparted to the lower region of the bore to be selectively reduced to avoid freezing the relatively cool molten metal moving through the lower region of the bore.

The described arrangement, by reducing the relative cooling action imparted to the lower region of the bore, also allows the overall cooling surfaces on the cooling cell to be moved closer to the bore to maximize the cooling affect without risking over-cooling of the molten metal in the lower region of the bore.

The described arrangement provides, with water pressures of 30 to 50 psi, a velocity through the passage for optimizing transfer of thermal energy from the sleeve structure to the liquid coolant. Its been found, for example, that the described arrangement produces a coolant flow rate of between 300 and 400 inches per minute through the wide portion of the coolant passage. Of course, higher flow rates prevail in the narrower parts of the passage and are usually above 1,000 inches per minute.

It will be understood that the compression fit of the cooling cell section on the die end of the shot sleeve is augmented and facilitated by the copper cladding or jacketing 18 and, specifically, since copper expands at a much higher rate than steel, the expanding copper layer during operation ensures a compression fit between the shot sleeve and the cooling cell section whereby to improve the efficiency of the heat transfer between the shot sleeve and the cooling cell section.

The described cooling arrangement will be seen to provide many important advantages. Specifically, the selectively varying cross-sectional width of the coolant passage allows the cooling effect to be maximized in regions of the bore such as the upper region where cooling is most needed and conversely allows cooling to be minimized in the regions of the bore such as the lower region where cooling is least needed and where in fact excessive cooling might cause solidification; since the cooling of the lower region of the bore is selectively reduced to avoid solidification the distance from the cooling surfaces in the cooling cell to the bore of the shot sleeve may be reduced, whereby to maximize cooling efficiency and minimize cycle times, without risking an over cooling condition in the lower region of the bore; the described design lends itself to the use of various cooling media such as water, oil and air; the copper jacket in combination with the cooling cell greatly augments the overall cooling action and thereby allows faster cycles; the large cooling surface area in the regions where cooling is most needed allows the velocity of the cooling fluid to be slowed to a velocity that increases the efficiency of heat transfer; the effective cooling area of the cooling cell on the top hemisphere is much greater to allow for more heat to be conducted through the cooling cell; and the heavy compression of the copper layer adds to the efficiency of the heat transfer.

Whereas a preferred embodiment of the invention has been illustrated and described in detail, it will be apparent that various changes may be made in the disclosed embodiment without departing from the scope or spirit of the invention.

What is claimed is:

1. A shot sleeve assembly for moving molten metal into a mold cavity, the assembly incuding:

an elongated horizontal shot sleeve having a bore extending axially therethrough from a first sleeve end to a second sleeve end adapted to be positioned proximate the mold cavity and a well opening extending through an upper region of a side wall of the sleeve at a location adjacent the first sleeve end;

an injection piston slidably mounted in the bore; and an annular cooling cell positioned over the second end of the sleeve and defining a coolant passage extending from a coolant inlet to a coolant outlet and having more surface area in surrounding relation to an upper region of the bore than to a lower region of the bore whereby to maximize cooling of the upper region of the bore and minimize cooling of the lower region of the bore.

2. A shot sleeve according to claim 1 wherein:

the inlet and outlet are in a lower region of the cell; and the passage is continuous and includes an inlet passage portion proximate the inlet, an outlet passage portion proximate the outlet, and a central passage portion interconnecting the inlet and outlet passage portions and extending upwardly and around the upper region of the bore; and the central passage portion has a larger axial width than the inlet and outlet passage portions whereby to provide more cooling surface area proximate the upper region of the bore than proximate the lower region of the bore.

3. A shot sleeve assembly according to claim 1 wherein the bore and cooling cell have a circular cross-sectional configuration and the passage is arcuate and is centered on the axis of the bore.

4. A shot sleeve assembly according to claim 3 wherein the shot sleeve assembly further includes a copper cladding layer interposed between the shot sleeve and the cooling cell.

5. A shot sleeve assembly according to claim 3 wherein the cooling cell has a compression fit on the sleeve.

6. A shot sleeve assembly according to claim 5 wherein the compression fit is facilitated by a copper cladding layer interposed between the cooling cell and sleeve.

7. A shot sleeve assembly according to claim 3 wherein the cooling cell is formed of an inner cell sleeve fitted over the shot sleeve and an outer cell sleeve fitted over the inner cell sleeve and coacting at its inner periphery with the outer periphery of the inner cell sleeve to define the coolant passage.

8. A shot sleeve assembly according to claim 7 wherein the inlet and outlet extend through a side wall of the outer cell sleeve for communication with the coolant passage.

9. A shot sleeve assembly for moving molten metal into a mold cavity and including an elongated horizontal shot sleeve having a bore extending axially therethrough from a first sleeve end to a second sleeve end adapted to be positioned proximate the mold cavity and a well opening extending through an upper region of a side wall of the sleeve at a location adjacent the first end; an injection piston slidably mounted in the bore; and a cooling cell positioned over the second end of the sleeve to cool the molten metal moving through the bore, characterized in that:

the cooling cell defines a continuous coolant passage extending from a coolant inlet to a coolant outlet and the passage presents more surface area in surrounding relation to an upper circumferential region of the bore than to a lower circumferential region of the bore.

10. A shot sleeve assembly according to claim 9 wherein the passage includes an inlet passage portion proximate the inlet, an outlet passage portion proximate the outlet, and a central passage portion interconnecting the inlet and outlet passage portions and extending upwardly and around the upper circumferential region of the bore; and the central passage portion has a larger axial width than the inlet and outlet passage portions whereby to present more cooling surface area proximate the upper circumferential region of the bore than proximate the lower circumferential region of the bore.

11. A shot sleeve assembly according to claim 10 wherein the bore and cooling cell have a circular cross-sectional configuration and the passage is arcuate and is centered on the axis of the bore.

12. A shot sleeve assembly according to claim 10 wherein the shot sleeve assembly further includes a copper cladding layer interposed between the shot sleeve and the cooling cell.

13. A shot sleeve assembly according to claim 10 wherein the cooling cell has a compression fit on the sleeve.

14. A shot sleeve assembly according to claim 13 wherein the compression fit is facilitated by a copper cladding layer interposed between the cooling cell and the sleeve.

15. A shot sleeve assembly according to claim 11 wherein the cooling cell is formed of an inner cell sleeve fitted over the shot sleeve and an outer cell sleeve fitted over the inner cell sleeve and coacting at its inner periphery with the outer periphery of the inner cell sleeve to define the coolant passage.

16. A shot sleeve assembly according to claim 15 wherein the inlet and outlet extend through a side wall of the outer cell sleeve for communication with the coolant passage.

17. A cooling cell in a shot sleeve assembly including a horizontal shot sleeve and a piston slidably positioned in a bore of the sleeve at a pour hole end of the sleeve and movable axially in the sleeve to eject molten metal inputted to the bore through a pour hole in the sleeve out of a die end of the sleeve and into a mold cavity defined by a casting die positioned proximate the die end of the sleeve, the cooling cell including an annular member adapted to be positioned over the die end of the sleeve and defining an inlet, an outlet, and a continuous passage interconnecting the inlet and the outlet and extending over the sleeve around a major portion of the circumference of the sleeve and presenting a relatively larger cooling surface area to the sleeve proximate an upper region of the sleeve and a relatively small cooling surface area to the sleeve proximate a lower region of the sleeve.

18. A cooling cell according to claim 17 wherein the passage has a relatively large axial width proximate the upper region of the sleeve and a relatively small axial width proximate the lower region of the sleeve.

19. A cooling cell according to claim 17 wherein an annular band of highly conductive material is interposed between the cooling cell and the sleeve.

20. A cooling cell according to claim 19 wherein the highly conductive material is copper.

21. A cooling cell according to claim 18 wherein:

the cooling cell is formed of an inner cell sleeve adapted to be fitted over the shot sleeve and an outer cell sleeve fitted over the inner cell sleeve; and the outer periphery of the inner cell sleeve is selectively relieved to define a groove conforming in size and shape to the passage and the passage is formed by the coaction of the inner periphery of the outer cell sleeve and the groove.

* * * * *